United States Patent [19]

Carmichael

[11] Patent Number: 4,717,056

[45] Date of Patent: Jan. 5, 1988

[54] INFANT CARRYING APPARATUS

[76] Inventor: Sandra Carmichael, R.R.-Box 5689C, Spirit Lake, Iowa 51360

[21] Appl. No.: 872,023

[22] Filed: Jun. 9, 1986

[51] Int. Cl.[4] ..... H61G 1/00

[52] U.S. Cl. ..... 224/158; 2/69.5; 5/98 R

[58] Field of Search ..... 224/158, 156, 159, 160, 224/202; 2/69.5; D6/390, 391; 5/93 R, 98 R, 98 B, 101

[56] References Cited

U.S. PATENT DOCUMENTS

| | | | |
|---|---|---|---|
| 2,622,250 | 12/1952 | Coles | 5/98 B |
| 2,628,358 | 2/1953 | Neils | 224/158 |
| 2,689,672 | 9/1954 | Thompson . | |
| 3,968,911 | 7/1976 | Haas . | |
| 4,087,874 | 5/1978 | Callaway et al. . | |
| 4,254,900 | 3/1981 | Wheeler . | |
| 4,333,591 | 6/1982 | Case . | |

FOREIGN PATENT DOCUMENTS

| | | | |
|---|---|---|---|
| 540672 | 10/1941 | United Kingdom | 224/158 |

*Primary Examiner*—Henry J. Recla

*Assistant Examiner*—David Voorhees

*Attorney, Agent, or Firm*—Henderson & Sturm

[57] ABSTRACT

An infant carrier having a cloth shell with a front, rear, bottom and side portions, the bottom portion being curved downwardly. Foam rubber is disposed within the shell in a semi-oval shape for substantially supporting the inside of the shell along the entire bottom and side portions thereof. An adjustable hood is attached to a top front portion thereof and is movable between a position to shield the infant's head from the elements or is movable to another position to provide ready access to the infant's face. Carrier straps extend from the top front of each of the side portions to the top rear of each of the side portions of the shell and forms an opening between a top intermediate part of the side portions of the shell and an intermediate portion of each carrier strap, whereby a person carrying the infant carrier can extend one arm through the opening so that intermediate portions of the carrier straps can rest on such person's shoulder to support the weight of an infant in the carrier. A plastic insert in the front portion of the shell helps to mold the foam into a semi-oval shape and also holds the cloth shell away from an infant's face.

12 Claims, 9 Drawing Figures

INFANT CARRYING APPARATUS

TECHNICAL FIELD

The present invention relates generally to an apparatus for safely and comfortably carrying infants from place to place, and more particularly to such a device which is lightweight and can be carried over one shoulder for this purpose.

BACKGROUND ART

There have been many different devices used over the years to carry babies from place to place or to hold an infant in a comfortable position. One of the most common devices of this type is a heavy rigid plastic container having some sort of a pad inside. Some of these devices have a handle which is movable between a position for carrying a baby and a position for tilting the front end upwardly to some extent. A major problem with baby carriers of this type is that they are extremely difficult to use in carrying an infant, primarily because it is clumsy and difficult to balance and hold when going from place to place. Also, when using such a device, it is quite often necessary to transfer the infant into or out from shopping carts, strollers, infant car seats, baby swings, etc., which is extremely awkward.

Accordingly, there is a need for a lighter weight infant carrier which makes the carrying of an infant easier, provides better balance for the carrier and more undisturbed comfort for the infant, as well as being adaptable to fit into shopping carts, strollers, infant seats or the like.

DISCLOSURE OF THE INVENTION

The present invention relates to an infant carrier having a cloth shell with a front, rear, bottom and side portions, the bottom portion being curved downwardly. A dense foam support is disposed within the shell for substantially lining the inside of the shell along the entire bottom and side portions thereof and giving the shell more structural integrity and an oval design. An adjustable hood is attached to a top front portion thereof and is movable between a position to shield the infant's head from the elements, or is movable to another position to provide ready access to the infant's face. Carrier straps extend from the top front of each of the side portions to the top rear of each of the side portions of the shell and forms an opening between a top intermediate part of the side portions of the shell and an intermediate portion of each carrier strap, whereby a person carrying the infant carrier can extend one arm through the opening so that intermediate portions of the carrier straps can rest on such person's shoulder to support the weight of an infant in the carrier.

An object of the present invention is to provide an improved infant carrier.

A further object of the present invention is to provide an infant carrier which is adaptable to fit into other infant holders, such as car seats or the like.

A further object of the present invention is to provide an infant carrier of the aforementioned type which is easily balanced and supported on one shoulder of a person using it.

A still further object of the invention is to provide an infant carrier of the aforementioned type which has an adjustable hood attached thereto.

A still further object of the invention is to provide a carrier which is more lightweight and has good weight distribution while still insuring comfortable support of an infant.

Other objects, advantages, and novel features of the present invention will become apparent from the following detailed description of the invention when considered in conjunction with the accompanying drawings.

BEST MODE FOR CARRYING OUT THE INVENTION

Figure 1:
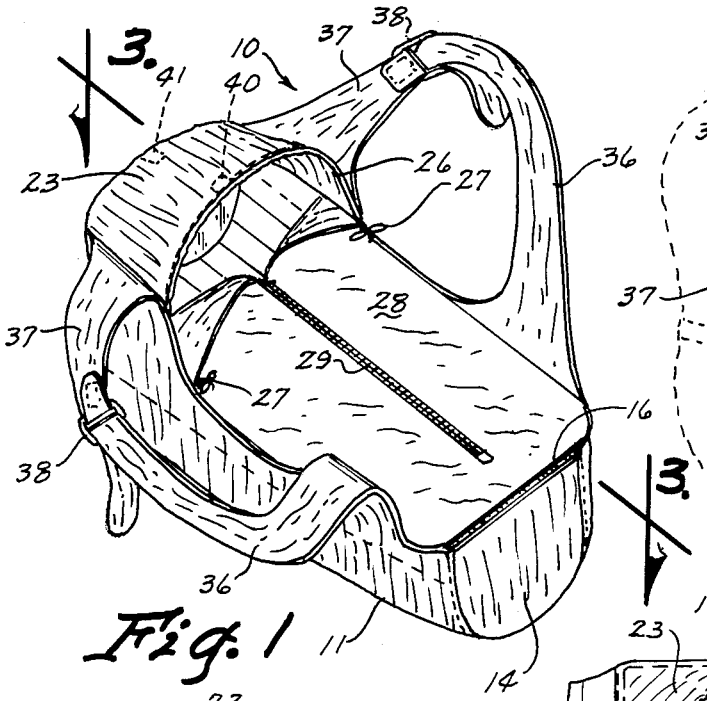
FIG. 1 is a perspective view of a preferred embodiment of the present invention.

Referring now to the drawings, wherein like reference numerals designate identical or corresponding parts throughout the several views, FIG. 1 shows an infant carrier (10) constructed in accordance with the present invention. The infant carrier (10) includes a cloth shell (11) which is preferably formed of a wash-and-wear material such as cotton and polyester corduroy with interfacing to provide extra strength. Other materials would also work satisfactorily, but they must be washable, and heavy enough for strength.

The shell (11) has a front end (12) sewn thereto and this front end (12) has a plate such as a rigid plastic plate (13). This plate (13) can flex to some extent, but must be stiff enough to reinforce the front portion (12) of the shell (11).

Figure 2:
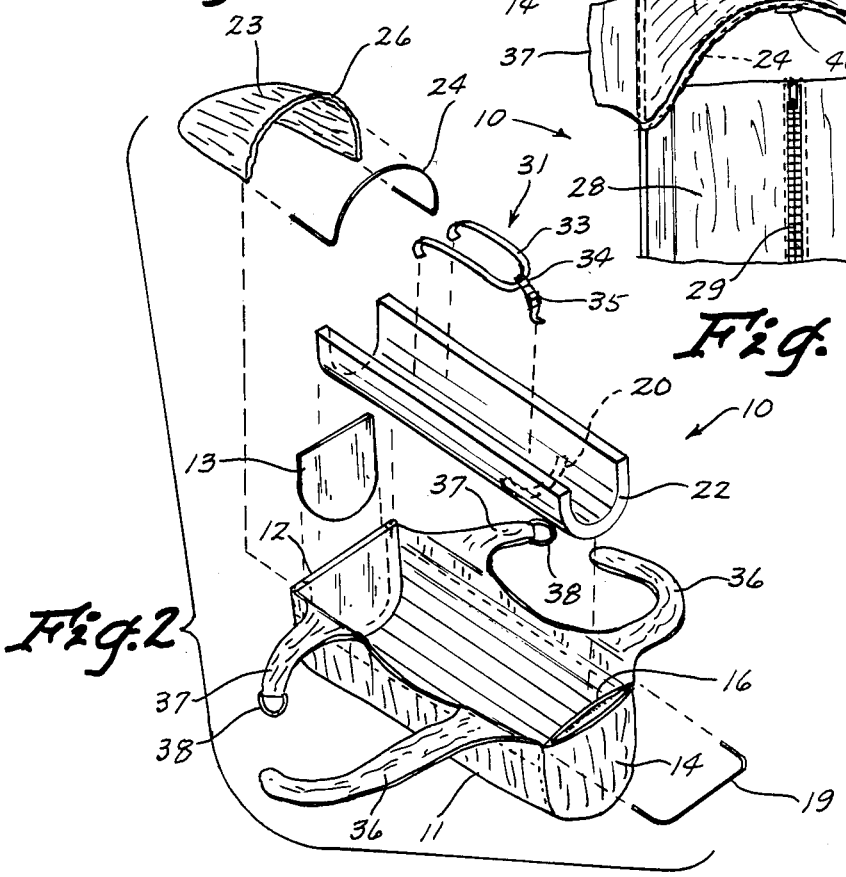
FIG. 2 is an exploded perspective view of the embodiment shown in FIG. 1.
Figure 3:
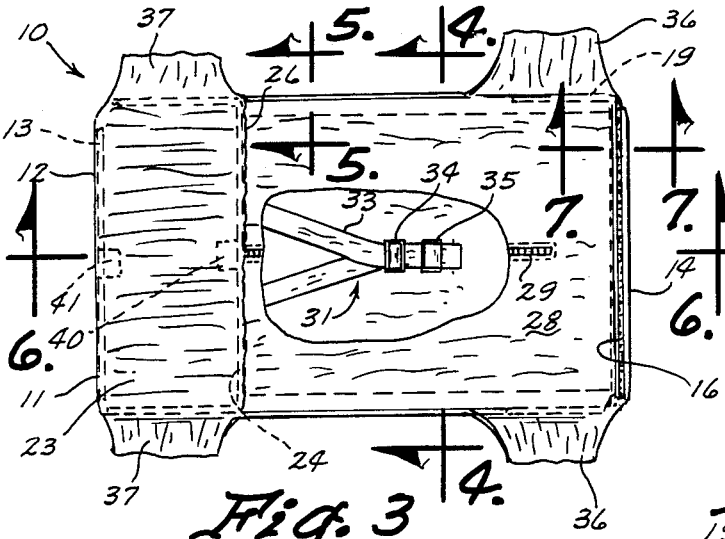
FIG. 3 is a cross sectional view taken along line 3—3 of FIG. 1.

A rear portion (14) of the shell (11) has an inner opening (16) thereon, such that a pocket is formed between the layers (14) and (16) which can be used like a diaper bag to store diapers and other items useful for taking care of babies. A polyethelene rod (19) extends through a loop (21) on member (16) and extends into part of the sidewalls of the shell (11) at the top of the foam for holding the top of the pocket where it needs to be. Alternatively, a plate similar to plate (13) can be attached to either one of the wall (16) or (14). A foam rubber support (22) can be formed of many materials, but one acceptable material would be a polyurethane foam. This foam rubber support (22) would ideally be made from a thickness of one inch to one and one-quarter inches, with the thickness increasing as a larger infant carrier is to be used. Also, the density can be 1.8 pounds per cubic square foot and the compression of 70 lbs. ILD in the preferred embodiment thereof. Other foam rubbers can be used interchangeably, assuming they have similar properties. This foam rubber member tends to return to a flat condition, but is bent into a U-shaped configuration as shown in FIG. 2.

A cloth hood (23) is sewn to the shell (11) and to the front portion (12) as can readily be seen in the drawings. This shell (23) is preferably formed of a material which will not shrink, such as a combination of cotton and polyester material. A one-eighth inch diameter high density polyethelene rod (24), for example of a type used as welding rods, is used to reinforce and hold up the rear end of the hood (23) and is sewn into a rear portion (26) of the hood (23) on top of the foam (22).

A cover for the baby having cloth portions (27 and 28) are also sewn to the edge of the shell (11) and this material should also be of a material which does not shrink very much, for example such as a blend of cotton and polyester. A zipper (29) is sewn into the cover (28) for allowing the cover to be opened or closed to provide easy access to the baby, easy insertion or removal of such baby as well. When it is zipped open, ties (27) which are attached to the shell (11) can be utilized to hold the cover (28) away from the infant. Also, pacifiers or toys can be tied to these ties (27) if desired.

Figure 7:
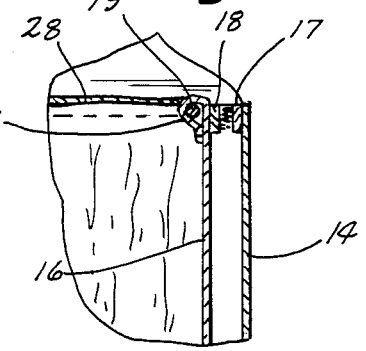
FIG. 7 is an enlarged cross sectional view taken along line 7—7 of FIG. 3.
Figure 6:
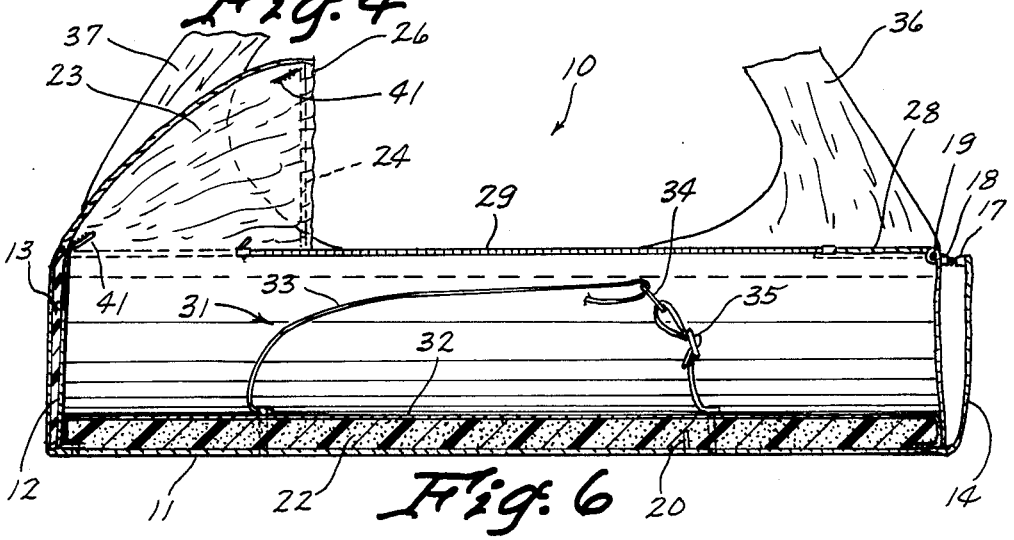
FIG. 6 is a cross sectional view taken along line 6—6 of FIG. 3.

Referring to FIGS. 6 and 7, it is noted that a safety strap (31) is attached to the inside of the carrier (10) for example by sewing through a cloth covering (32) around the foam rubber (22) and through the foam rubber (22). This harness (31) is comprised of straps (33) and buckles (34) and (35) permit the harness (31) to be adjusted to the size of the baby.

The shell (11) is typically made in one piece with carrier straps (36) and (37) on each side thereof. These carrier straps are interconnected by a buckle (38) which can be of the metal variety shown or they can also be of a plastic snap-type buckle. These modern plastic buckles tend to prevent slippage more than the older metal types. It is also to be understood that the buckles (38) are a feature not absolutely necessary to this invention because the straps (36) and (37) could be made different sizes so that a user would merely choose the size needed for them.

Figure 5:
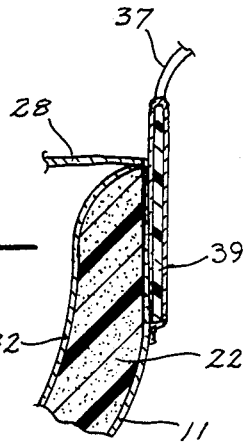
FIG. 5 is an enlarged partial cross sectional view taken along line 5—5 of FIG. 3.
Figure 4:
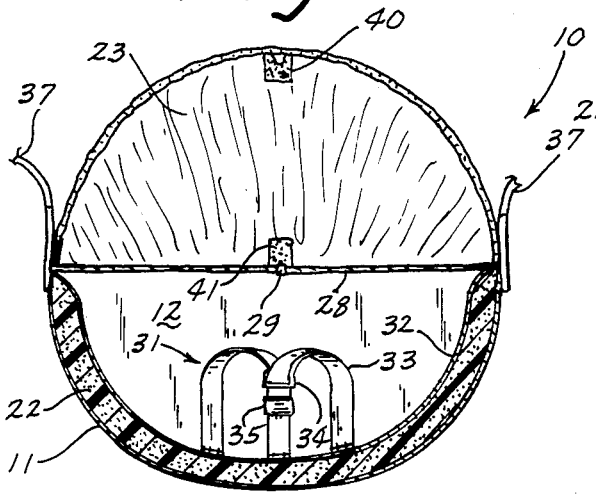
FIG. 4 is a cross sectional view taken along line 4—4 of FIG. 3.

By having the foam rubber support (22) bent into an oval or U-shape as shown in FIG. 4, the upper walls of the foam tend to prevent the bottom from buckling under the weight of an infant. The lowest portion of foam rubber support (22) also becomes compressed when the support (22) is bent into a U-shape. Additional rigidity or resistance to buckling of the bottom of the U-shaped foam rubber support (22) is obtained by taut sewing of the top side edges of the cloth (32) to the shell (11) as shown in FIG. 5. The compression of the top side edges of foam support (22) shown in FIG. 5 makes the top edge more dense, and more rigid and more resistant to bending forces created by the weight of an infant in the harness (31).

The purpose of the soft infant carrier (10) is to provide an improved method of transporting an infant aged newborn to eight months. It provides a practical lightweight alternative to the heavy clumsy plastic infant carriers presently in popular use. The present invention (10) has been designed for the active mobile mother, yet provides maximum comfort to the infant. It is also designed to be adaptable to many existing products and circumstances, such as placement of the device in shopping carts, strollers, infant car seats, baby swings, etc. It provides convenience for the mother, as well as comfort to both the mother and the infant. This is accomplished through the oval design, density of foam and taut sewing of the dense foam to the outer oval shell. This taut sewing of the dense foam to the outer shell creates an even distribution of weight to the oval strapping (36) and (37), therefore making it easier to carry. Plastic reinforcement in head panels (39) is utilized if desire to help prevent buckling of the carrier in the middle.

In operation, the infant carrier (10) would be zipped open by using the zipper (29) and the infant would be inserted on the cloth layer (32) which is directly above the foam rubber (22). Then the buckles (34) and (35) and straps (33) of safety harness (31) would be utilized to hold the baby's face up inside of the infant carrier (10). When the baby is being placed into the carrier (10), mating Velcro fasteners (40 and 41) would be placed together to hold the hood (23) back out of the way. Once the infant is safely in the harness (31), then the cover (28) can be closed by using the zipper (29) and the hood (23) can be placed again in the position shown in FIGS. 1, 3, 4, and 6 to protect the baby's eyes from sun, rain or winds. The loop under hood rod (24) holds up the blanket off of the infant's face, but still protects the infant from cold winds. For example, the arch of the rod (24) still allows vital air space around baby's face. The ribbon (27) ties to the loop in the arch.

Figure 9:
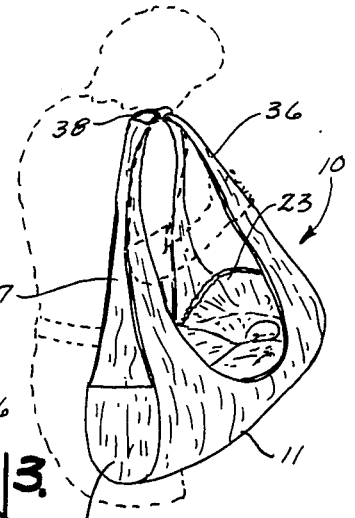
FIG. 9 is a perspective view showing the present invention being carried over the shoulder of a person as when it would be in use carrying an infant.
Figure 8:
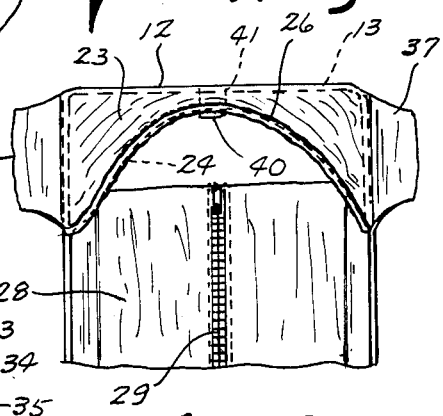
FIG. 8 is a top view of the front portion of the device showing the hood pulled back and attached in such a position by a Velcro fastener.

When it is desired to carry the baby in the carrier (10), it would be placed over a person's shoulder with an arm extending out through the opening formed inside of straps (36) and (37), for example as shown in FIG. 9. With the infant carrier in this position, it is very comfortable for the person carrying the baby, as well as for the baby itself. Because of the oval design, an even weight distribution is achieved so that the baby is outstretched and unencumbered.

If it is desired to place the carrier into a shopping cart, stroller, etc., this can easily be accommodated, while keeping the baby safe and undisturbed. For example, the plastic plate (13) holds the front end of the carrier upwardly and out of the baby's face while the plastic rod (24) holds the hood (23) upwardly as well. Slot (20) in the bottom of foam (22) permits the carrier (10) to easily bend at slot (20), so the infant can be in a sitting position in a stroller or the like. When it is desired to have access to the baby, such as for feeding, for diaper changing, or for removing the baby from the carrier (10), the hood can readily beheld back by the Velcro fasteners (40) and (41) and the cover (28) can readily be opened by use of the zipper (29). The cover (28) also acts as a safety factor because it will prevent the infant from falling out of the carrier (10) when it is zipped up.

The advantage of the cradle design is that when the carrier is placed on the ground, it can be rocked back and forth like a cradle. This is due to the foam's stability and the molding of the plastic panel. It takes on the appearance and similar function of a cradle.

Obviously, many modifications and variations of the present invention are possible in light of the above teachings. It is therefore to be understood that, within the scope of the appended claims, the invention may be practised otherwise than as specifically described.

I claim:

1. An infant carrier comprising:

a shell formed of heavy cloth having a front portion, a rear portion, side portions and a bottom portion, said bottom portion being curved downwardly, said shell having an inside and an outside;

a plate means of substantially the same shape as said front portion being attached adjacent to said front portion for reinforcing said front portion;

foam support means for substantially lining the inside of said shell along the entire bottom and side portions thereof, the top of the side edges of the foam support means being compressed by taut sewing thereof to the shell to help prevent buckling of the foam support under the weight of an infant in the carrier;

adjustable hood means attached to the top of the front portion and to parts of each side portion adjacent the front thereof for covering the head of a baby disposed in said shell and on said foam support means; and carrier strap means disposed on each side of said shell, each strap means extending from the top front of each side portion to the top rear of each side portion of the shell and forming an opening between a top intermediate part of the side portions of the shell and an intermediate portion of each carrier strap means whereby a person's arm can extend through said openings so that the intermediate portions of the carrier strap means can rest on such person's shoulder to support the weight of an infant in the carrier.

2. The infant carrier of claim 1 including means attached to said intermediate portion of each carrier strap means for selectively adjusting the length of each respective carrier strap means.

3. The infant carrier of claim 1 including means for forming a closeable pocket in the rear portion of said shell.

4. The infant carrier of claim 1 including a curved rod attached to the rear portion of the hood means for holding the hood upwardly out of the infant's face.

5. The infant carrier of claim 1 including Velcro means having one portion thereof attached to a rear central portion of the hood means and another mating part thereof attached to a top inside, central part of the front portion of the shell for selectively holding the hood forward to provide access to the infant's face.

6. The infant carrier of claim 1 including safety strap means attached to said foam support means for holding an infant securely in the carrier.

7. The infant carrier of claim 1 including reinforcing means disposed across the top of the rear portion for preventing the top of the rear portion from sagging.

8. The infant carrier of claim 1 including cover means attached to the top of the rear and side portions of the shell for covering an infant.

9. The infant carrier of claim 8 including zipper means extending from an extreme front part to a rear part of the cover means for selectively opening or closing said cover means.

10. The infant carrier of claim 9 wherein said zipper means is disposed equidistantly from the side portions of the shell.

11. The infant carrier of claim 3 including a Velcro means for opening or closing said pocket means.

12. The infant carrier of claim 1 wherein the foam support means is semi-oval shaped in cross section, whereby the sidewalls will tend to prevent buckling under the weight of an infant in the carrier.

* * * * *